US006107450A

United States Patent [19]

Harrison et al.

[11] Patent Number: 6,107,450

[45] Date of Patent: Aug. 22, 2000

[54] POLYALKYLENE SUCCINIMIDES AND POST-TREATED DERIVATIVES THEREOF

[75] Inventors: James J. Harrison, Novato; Anatoli Onopchenko, Concord; William R. Ruhe, Jr., Benicia, all of Calif.

[73] Assignee: Chevron Chemical Company LLC, San Ramon, Calif.

[21] Appl. No.: 09/212,078

[22] Filed: Dec. 15, 1998

[51] Int. Cl.[7] ..... C08G 69/36; C10M 149/10; C10L 1/22

[52] U.S. Cl. ..... 528/329.1; 528/332; 528/335; 528/336; 528/486; 508/192; 508/222; 526/262; 44/317; 44/330; 44/331; 44/346

[58] Field of Search ..... 528/329.1, 332, 528/335, 336, 486; 508/192, 222; 526/262; 44/317, 330, 331, 346

[56] References Cited

U.S. PATENT DOCUMENTS

| | | | |
|---|---|---|---|
| 3,018,250 | 1/1962 | Anderson et al. | 252/51.5 |
| 3,172,892 | 3/1965 | LeSuer | 260/326.5 |
| 3,219,666 | 11/1965 | Norman et al. | 260/268 |
| 3,361,673 | 1/1968 | Stuart et al. | 252/51.5 |
| 3,381,022 | 4/1968 | LeSuer | 260/404.8 |
| 3,819,660 | 6/1974 | Cahill et al. | 260/346.8 R |
| 3,912,764 | 10/1975 | Palmer, Jr. | 260/346.8 |
| 4,234,435 | 11/1980 | Meinhardt et al. | 252/51.5 A |
| 4,235,786 | 11/1980 | Wisotsky | 260/346.74 |
| 4,612,132 | 9/1986 | Wollenberg et al. | 252/51.5 A |
| 4,747,965 | 5/1988 | Wollenberg et al. | 252/51.5 A |
| 5,112,507 | 5/1992 | Harrison | 252/51.5 A |
| 5,241,003 | 8/1993 | Degonia et al. | 525/123 |
| 5,266,186 | 11/1993 | Kaplan | 208/44 AA |
| 5,286,799 | 2/1994 | Harrison et al. | 525/285 |
| 5,319,030 | 6/1994 | Harrison et al. | 525/285 |
| 5,334,321 | 8/1994 | Harrison et al. | 252/51.5 A |
| 5,356,552 | 10/1994 | Harrison et al. | 252/51.5 A |
| 5,716,912 | 2/1998 | Harrison et al. | 508/192 |
| 5,777,025 | 7/1998 | Spencer et al. | 524/745 |

FOREIGN PATENT DOCUMENTS

| | | | |
|---|---|---|---|
| 0 542 380 | 5/1993 | European Pat. Off. | C08F 8/46 |
| 0 682 102 | 11/1995 | European Pat. Off. | C10M 159/12 |

*Primary Examiner*—Duc Truong
*Attorney, Agent, or Firm*—W. K. Turner; R. J. Sheridan

[57] ABSTRACT

A succinimide composition is prepared by reacting a mixture of a polyalkenyl derivative, an unsaturated acidic reagent copolymer, and a polyamine under reactive conditions. The polyalkenyl derivative is produced by reacting an unsaturated acidic reagent with a polyalkene in the presence of a strong acid. The unsaturated acidic reagent copolymer is a copolymer of an unsaturated acidic reagent and an olefin.

25 Claims, No Drawings

POLYALKYLENE SUCCINIMIDES AND POST-TREATED DERIVATIVES THEREOF

The present invention relates to novel compositions comprising polyalkylene succinimides and post-treated derivatives of polyalkylene succinimides. In a further aspect, the invention relates to methods of preparing these compositions and their uses as dispersants in lubricating oils and deposit inhibitors in hydrocarbon fuels. In another aspect, the invention relates to concentrates, lubricating oil compositions, and hydrocarbon fuel compositions containing such novel compositions.

BACKGROUND OF THE INVENTION

Lubricating oil compositions for internal combustion engines generally contain a variety of additives to reduce or control deposits, wear, corrosion, etc. Similarly, liquid hydrocarbon fuels for internal composition engines, at a minimum, contain additives which control or reduce the formation of deposits. The present invention is concerned with compositions useful as dispersants or deposit inhibitors.

In lubricating oils, dispersants function to control sludge, carbon, and varnish produced primarily by the incomplete oxidation of the fuel, or impurities in the fuel, or impurities in the base oil used in the lubricating oil composition. Dispersants also control viscosity increase due to the presence of soot in diesel engine lubricating oils.

Deposit inhibitors in fuel control or reduce engine deposits also caused by incomplete combustion of the fuel. Such deposits can form on the carburetor parts, throttle bodies, fuel injectors, intake ports, and valves. Those deposits can present significant problems, including poor acceleration and stalling, and increased fuel consumption and exhaust pollutants.

One of the most effective classes of lubricating oil dispersants and fuel deposit inhibitors is polyalkylene succinimides. In some cases, the succinimides have also been found to provide fluid-modifying properties, or a so-called viscosity index credit, in lubricating oil compositions. This results in a reduction in the amount of viscosity index improver, which would be otherwise required. A drawback of succinimide dispersants is that they have generally been found to reduce the life of fluorocarbon elastomers. In general, for a given succinimide dispersant, a higher nitrogen content gives better dispersancy but poorer fluorocarbon elastomer compatibility.

Therefore, as well as improving the dispersancy and VI credit properties of polyalkylene succinimides, it would be desirable to improve the fluorocarbon elastomer compatibility of such dispersants. It would further be desirable to improve the stability of polyalkylene succinimides, particularly hydrolytic stability and shear stress stability. It would also be desirable to improve soot dispersancy, especially where the lubricating oil is intended for use in diesel engine crankcases.

Polyalkylene succinimides are generally prepared by the reaction of the corresponding polyalkylene succinic anhydride with a polyalkyl polyamine. Polyalkylene succinic anhydrides are generally prepared by a number of well-known processes. For example, there is a well-known thermal process (see, e.g., U.S. Pat. No. 3,361,673), an equally well-known chlorination process (see, e.g., U.S. Pat. No. 3,172,892), a combination of the thermal and chlorination processes (see, e.g., U.S. Pat. No. 3,912,764), and free radical processes (see, e.g., U.S. Pat. Nos. 5,286,799 and 5,319,030). Such compositions include one-to-one monomeric adducts (see, e.g., U.S. Pat. Nos. 3,219,666 and 3,381,022), as well as "multiply adducted" products, adducts having alkenyl-derived substituents adducted with at least 1.3 succinic groups per alkenyl-derived substituent (see, e.g., U.S. Pat. No. 4,234,435).

U.S. Pat. Nos. 3,361,673 and 3,018,250 describe the reaction of an alkenyl- or alkyl-substituted succinic anhydride with a polyamine to form alkenyl or alkyl succinimide lubricating oil dispersants and/or detergent additives.

U.S. Pat. No. 4,612,132 teaches that alkenyl or alkyl succinimides may be modified by reaction with a cyclic or linear carbonate or chloroformate such that one or more of the nitrogens of the polyamine moiety is substituted with a hydrocarbyl oxycarbonyl, a hydroxyhydrocarbyl oxycarbonyl, or a hydroxy poly(oxyalkylene) oxycarbonyl. These modified succinimides are described as exhibiting improved dispersancy and/or detergency in lubricating oils.

U.S. Pat. No. 4,747,965 discloses modified succinimides similar to those disclosed in U.S. Pat. No. 4,612,132, except that the modified succinimides are described as being derived from succinimides having an average of greater than 1.0 succinic groups per long chain alkenyl substituent.

An article by S. T. Roby, R. E. Kornbrekke, and J. A. Supp "Deposit Formulation in Gasoline Engines, Part 2, Dispersant Effects on Sequence VE Deposits" JOURNAL OF THE SOCIETY OF TRIBOLOGISTS AND LUBRICATION ENGINEERS, Vol. 50, 12, 989–995 (December 1994) teaches that the length of the dispersant alkyl side chain influences deposit control performance, and that, at the same nitrogen level, the low molecular weight (side chain 1000 daltons) dispersants that were tested were poorer than the tested high molecular weight (side chain 2000 daltons) succinimide dispersants.

U.S. Pat. No. 4,234,435 teaches a preferred polyalkene-derived substituent group with a number average molecular weight ($M_n$) in the range of 1500–3200. For polybutenes, an especially preferred $M_n$ range is 1700–2400. This patent also teaches that the succinimides must have a succinic ratio of at least 1.3. That is, there should be at least 1.3 succinic groups per equivalent weight of polyalkene-derived substituent group. Most preferably, the succinic ratio should be from 1.5 to 2.5. This patent further teaches that its dispersants also provide an improvement in viscosity index. That is, these additives impart fluidity modifying properties to lubricant compositions containing them. This is considered desirable for use in multigrade lubricating oils but undesirable for single-grade lubricating oils.

Polyamino alkenyl or alkyl succinimides and other additives useful as dispersants and/or detergents, such as Mannich bases, contain basic nitrogen. While basicity is an important property to have in the dispersant/detergent additive, it is believed that the initial attack on fluorocarbon elastomer seals used in some engines involves attack by the basic nitrogen. This attack leads to the loss of fluoride ions, and eventually results in cracks in the seals and loss of other desirable physical properties.

A variety of post-treatments for improving various properties of alkenyl succinimides are known to the art, a number of which are described in U.S. Pat. No. 5,241,003.

Example 2 of U.S. Pat. No. 5,266,186 discloses the preparation of dispersants by reacting certain polyisobutenyl-succinic anhydride adducts (see footnote 2 of Table 2) with ethylenediamine, followed by reaction with a maleic anhydride/alpha-olefin copolymer. The patent teaches that, by functioning as an iron sulfide dispersant, the product is useful to inhibit sludge deposits in refinery processing equipment caused by the heat treatment of hydrocarbon feed stocks.

U.S. Pat. No. 5,112,507 discloses a polymeric ladder type polymeric succinimide dispersant in which each side of the ladder is a long chain alkyl or alkenyl, generally having at least about 30 carbon atoms, preferably at least about 50 carbon atoms. The dispersant, described as having improved hydrolytic stability and shear stress stability, is produced by the reaction of certain maleic anhydride-olefin copolymers with certain polyamines. The patent further teaches that the polymer may be post-treated with a variety of post-treatments, and describes procedures for post-treating the polymer with cyclic carbonates, linear mono- or polycarbonates; boron compounds (e.g., boric acid), and fluorophosphoric acid and ammonia salts thereof.

U.S. Pat. Nos. 5,334,321 and 5,356,552 disclose certain cyclic carbonate post-treated alkenyl or alkylsuccinimides having improved fluorocarbon elastomer compatibility, which are preferably prepared by the reaction of the corresponding substituted succinic anhydride with a polyamine having at least four nitrogen atoms per mole.

European Application, EP 0 682 102 A2 discloses a process which comprises reacting: a copolymer of an olefin and maleic anhydride, an acyclic hydrocarbyl-substituted succinic acylating agent, and an alkylene polyamine. These products are described as useful in lubricating oil compositions as additives for use as dispersants having viscosity index improver properties.

U.S. Pat. No. 3,819,660, titled "Alkenylsuccinic Anhydride Preparation," discloses the suppression of fumaric acid sublimation and tar formation during reaction of a 168 to 900 molecular weight alkene with maleic anhydride and increased yield of alkenylsuccinic anhydride by using a catalytic amount of p-alkylbenzenesulfonic acid.

U.S. Pat. No. 4,235,786, titled "Process for Producing Oil-Soluble Derivatives of Unsaturated $C_4$–$C_{10}$ Dicarboxylic Acid Materials," discloses the Ene reaction of an unsaturated $C_4$–$C_{10}$ dicarboxylic acid and a $C_{30}$–$C_{700}$ olefin carried out in the presence of an oil-soluble, strong organic acid having a $pK_a$ of less than 4, such as sulfonic acid.

U.S. Pat. No. 5,777,025, titled "Process for Preparing Polyalkenyl Substituted $C_4$ to $C_{10}$ Dicarboxylic Acid Producing Materials," discloses a process for preparing a polyalkylene derivative of a monounsaturated $C_4$ carboxylic acid by running the reaction in the presence of a sediment-inhibiting amount of an oil-soluble hydrocarbyl substituted sulfonic acid.

European Patent Application 0 542 380 A1, titled "Process for the preparation of polyalkenyl derivatives of unsaturated dicarboxylic acid materials," discloses a process for the preparation of a polyalkenyl derivative of a monoethylenically unsaturated $C_4$–$C_{10}$ dicarboxylic acid material wherein the ratio of dicarboxylic acid moieties per polyalkenyl chain is less than 1.2:1. That process comprises reacting a polyalkene having a $M_n$ in the range of 950 to 5000 with a monoethylenically unsaturated $C_4$–$C_{10}$ dicarboxylic acid material in a mole ratio of greater than 1:1 at a temperature in the range of 150° to 260° C. in the presence of a polyaddition-inhibiting amount of a sulfonic acid.

SUMMARY OF THE INVENTION

The present invention provides an improved process for the preparation of a succinimide composition. In this process, a specific mixture is reacted under reactive conditions. This mixture comprises a polyalkenyl derivative of an unsaturated acidic reagent, an unsaturated acidic reagent copolymer, and an alkylene polyamine. The polyalkenyl derivative of an unsaturated acidic reagent is prepared by reacting an unsaturated acidic reagent with a polyalkene in the presence of a strong acid. The unsaturated acidic reagent copolymer is a copolymer of an unsaturated acidic reagent and an olefin.

That process is based, in part, upon the discovery that forming the polyalkenyl derivative of an unsaturated acidic reagent in the presence of a strong acid catalyst significantly improves the conversion of the polyalkenyl derivative and ultimately of the final succinimide.

In one embodiment, the polyalkene initially contains greater than about 50% of the methylvinylidene isomer, and the polyalkene is treated with strong acid prior to the reaction with the unsaturated acidic reagent so that less than 50% (more preferably less than 40%) of the polyalkene has methylvinylidene end groups.

Preferably, the polyalkene is a polybutene, more preferably a polyisobutene. Preferably, the polyalkene has a molecular weight of from 500 to 3000.

Preferably, the unsaturated acidic reagent used to form the polyalkenyl derivative and used to form the unsaturated acidic reagent copolymer is maleic anhydride.

Preferably, the mole ratio of unsaturated acidic reagent to polyalkene in the formation of the polyalkenyl derivative is 1:1 or greater.

Preferably, the strong acid is an oil-soluble, strong organic acid, having a $pK_a$ of less than about 4. More preferably, it is a sulfonic acid, such as an alkyl aryl sulfonic acid, wherein the alkyl group has from 4 to 30 carbon atoms. Preferably, the sulfonic acid is present in an amount in the range of from 0.0025% to 1% based on the total weight of polyalkene.

Preferably, the unsaturated acidic reagent copolymer is a copolymer of maleic anhydride and an olefin having an average of from 14 to 30 carbon atoms. Preferably, the copolymer has a molecular weight of from 2000 to 4800.

Preferably, the polyamine has at least three nitrogen atoms (more preferably at least six nitrogen atoms) and 4 to 20 carbon atoms.

Preferably, the reaction mixture contains about from 1 to 10 equivalents of the polyalkenyl derivative per equivalent of the unsaturated acidic reagent copolymer and about from 0.4 to 1 moles of the polyamine per equivalent of polyalkenyl derivative plus unsaturated acidic reagent copolymer.

The present invention further provides a fuel composition comprising a major amount of hydrocarbons boiling in the gasoline or diesel range and from 10 to 10,000 parts per million of the succinimide composition of the present invention.

The present invention further provides lubricating oil compositions comprising a major amount of a base oil of lubricating viscosity and a minor amount of the compounds of the invention ("active ingredients"). The active ingredients can be applied at effective amounts, which are highly effective to control engine sludge and varnish and yet be compatible with fluorocarbon elastomer engine seals. The invention also provides a concentrate comprising about 20 to 60 wt. % of the compounds or compound mixtures and about 40 to 80 wt. % of a compatible liquid diluent designed to be added directly to a base oil. Both the lubricating oil composition and concentrate may also contain other additives designed to improve the properties of the base oil, including other detergent-dispersants.

The corresponding post-treated derivative can be obtained by treating the reaction product with the desired post-treatment. For example, the reaction product is preferably treated with a cyclic carbonate, preferably ethylene carbonate, preferably by the procedure described in U.S. Pat. Nos. 4,612,132 and 5,334,321 hereby incorporated by reference.

In one embodiment, when the succinimide is post-treated with ethylene carbonate, the ratio of 70/72 peaks in the quantitative $^{13}C$ NMR spectrum of that post-treated succinimide is at least 2.

Additional aspects of the invention will be apparent from the following detailed description.

DETAILED DESCRIPTION OF THE INVENTION

In its broadest aspect, the present invention involves the discovery that, in the process for the preparation of succinimide by reacting a polyalkenyl derivative of an unsaturated acidic reagent, an unsaturated acidic reagent copolymer, and an alkylene polyamine, a higher percent actives is obtained if the polyalkenyl derivative is formed in the presence of a strong acid. The higher percent actives of the succinimide is a direct result of the higher conversion of the polyalkenyl derivative that is obtained by reacting the polyalkene with the unsaturated acidic reagent in the presence of the strong acid.

In addition beneficial properties of the ethylene carbonate post treated succinimide are obtained by using the polyalkenyl derivative formed in the presence of a strong acid.

For example, we have found that the succinimides prepared according to this invention have lower viscosity at the same percent actives, compared to the succinimides prepared without the strong acid. It is thought that this is due to the fact that the succinimides prepared without the strong acid contain higher amounts of unreacted polyalkene.

In addition, the ethylene carbonate post treated succinimides prepared according to this invention contain greater stringing of the ethylene carbonate compared to the ethylene carbonate post treated succinimides prepared without the strong acid. (Stringing is the number of hydroxy ethyl groups that are joined together in the post treated product). Increased stringing of the ethylene carbonate is generally considered to be a beneficial property of the succinimide and results in improved dispersancy properties.

The process for forming the succinimide comprises reacting a mixture under reactive conditions, wherein the mixture comprises:

(a) a polyalkenyl derivative of an unsaturated acidic reagent prepared by reacting an unsaturated acidic reagent with a polyalkene in the presence of a strong acid;

(b) an unsaturated acidic reagent copolymer of
  (1) an unsaturated acidic reagent and
  (2) an olefin; and (c) an alkylene polyamine.

DEFINITIONS

As used herein the following terms have the following meanings, unless expressly stated to the contrary.

The term "succinimide" is understood in the art to include many of the amide, imide, etc. species which are also formed by the reaction of a succinic anhydride with an amine. The predominant product, however, is succinimide, and this term has been generally accepted as meaning the product of a reaction of an alkenyl- or alkyl-substituted succinic acid or anhydride with a polyamine. Alkenyl or alkyl succinimides are disclosed in numerous references and are well known in the art. Certain fundamental types of succinimides and related materials encompassed by the term of art "succinimide" are taught in U.S. Pat. Nos. 2,992,708; 3,018,291; 3,024,237; 3,100,673; 3,219,666; 3,172,892; and 3,272,746, the disclosures of which are hereby incorporated by reference.

The term "Total Base Number" or "TBN" refers to the amount of base equivalent to milligrams of KOH in 1 gram of sample. Thus, higher TBN numbers reflect more alkaline products and therefore a greater alkalinity reserve. The TBN of a sample can be determined by ASTM Test No. D2896 or any other equivalent procedure.

The "succinic ratio" or "succination ratio" refers to the ratio calculated in accordance with the procedure and mathematical equation set forth in columns 5 and 6 of U.S. Pat. No. 5,334,321, hereby incorporated by reference. The calculation is asserted to represent the average number of succinic groups in an alkenyl or alkylsuccinic anhydride per alkenyl or alkyl chain. Actually the "succinic ratio" is more complicated than this. It is a measure of the average number of succinic groups per alkenyl chain plus the percentage of soluble resin in the alkenylsuccinic anhydride sample. Measurement of the % actives fraction, the SAP number and the polybutene number average molecular weight are insufficient by themselves to separate out the individual contributions of soluble resin and the average number of succinic groups per alkenyl chain. A separate measure of the percentage of soluble resin can be made by separating out the soluble resin by solvent extraction or chromatography for example.

The term "PIBSA" means polyisobutenyl succinic anhydride.

The term "polyalkenyl derivative of an unsaturated acidic reagent" refers to a structure having the formula

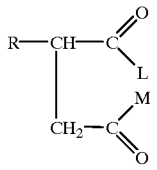

wherein R is a polyalkenyl group, L and M are independently selected from the group consisting of —OH, —Cl, —O—, lower alkyl or taken together are —O— to form an alkenyl or alkylsuccinic anhydride group.

The term "unsaturated acidic reagent" refers to maleic or fumaric reactants of the general formula:

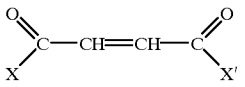

wherein X and X' are the same or different, provided that at least one of X and X' is a group that is capable of reacting to esterify alcohols, form amides, or amine salts with ammonia or amines, form metal salts with reactive metals or basically reacting metal compounds and otherwise function as acylating agents. Typically, X and/or X' is —OH, —O-hydrocarbyl, —$OM^+$ where $M^+$ represents one equivalent of a metal, ammonium or amine cation, —$NH_2$, —Cl, —Br, and taken together X and X' can be —O— so as to form an anhydride. Preferably, X and X' are such that both carboxylic functions can enter into acylation reactions. Maleic anhydride is a preferred unsaturated acidic reactant. Other suitable unsaturated acidic reactants include electron-deficient olefins such as monophenyl maleic anhydride; monomethyl, dimethyl, monochloro, monobromo, monofluoro, dichloro and difluoro maleic anhydride, N-phenyl maleimide and other substituted maleimides; isomaleimides; fumaric acid, maleic acid, alkyl hydrogen maleates and fumarates, dialkyl fumarates and maleates, fumaronilic acids and maleanic acids; and maleonitrile, and fumaronitrile.

The SAP number is a measure of the amount of acid or anhydride equivalents in a sample of the alkenyl or alkyl succinic anhydride. It is generally measured by known procedures such as ASTM D94, or by FTIR spectroscopy. The units are generally reported as mg KOH/g sample.

The % actives of the alkenyl or alkyl succinic anhydride can be determined using a chromatographic technique. This method is described in column 5 and 6 in U.S. Pat. No. 5,334,321.

The percent conversion of the polyolefin is calculated from the % actives using the equation in column 5 and 6 in U.S. Pat. No. 5,334,321.

Unless stated otherwise, all percentages are in weight percent and all molecular weights are number average molecular weights.

SYNTHESIS

The compounds of the present invention can be prepared by contacting the desired polyalkenyl derivative with an unsaturated acidic reagent copolymer and polyamine under reactive conditions.

Typically, the above process is conducted by contacting from 1 to 10 equivalents of polyalkenyl derivative per mole of unsaturated acidic reagent copolymer and from 0.4 to 1 equivalents of amine per equivalent of alkenyl or alkylsuccinic acid derivative plus unsaturated acidic reagent copolymer. In conducting this reaction, we have generally found it convenient to first add the alkenyl or alkylsuccinic acid derivative and the unsaturated acidic reagent copolymer together and then add the polyamine. It may be desirable to conduct the reaction in an inert organic solvent or diluent. Optimum solvents will vary with the particular copolymer and can be determined from literature sources or routine experimentations. For example, in the case of maleic anhydride poly $\alpha$-olefin copolymers, we found that neutral oil and mixtures of $C_9$ to $C_{11}$ aromatic solvents are acceptable solvents.

Typically, the reaction is conducted at temperatures in the range of about from 140° to 180° C., preferably 150° to 170° C. for about from 1 to 10 hours, preferably 4 to 6 hours. Typically the reaction is conducted at about atmospheric pressure; however, higher or lower pressures can also be used depending on the reaction temperature desired and the boiling point of the reactants or solvent.

As above noted, the reaction product will typically be a mixture, both because of the secondary products or byproducts and also because the reactants will typically be mixtures. In theory, pure compounds could be obtained, for example by using pure compounds as reactants and then separating out the desired pure compounds from the reaction product.

Water, present in the system or generated by the reaction of the amine with the succinic or maleic anhydride moieties, is preferably removed from the reaction system during the course of the reaction via azeotroping, inert gas stripping, or distillation. At any time during the reaction, the system can be stripped at elevated temperatures (typically 100° C. to 250° C.) and reduced pressures to remove any volatile components which may be present in the product.

THE POLYALKENYL DERIVATIVE OF AN UNSATURATED ACIDIC REAGENT

In the preparation of the polyalkenyl derivative, a polyalkene is reacted with an unsaturated acidic reagent at elevated temperatures in the presence of strong acid, to produce a polyalkenyl derivative of an unsaturated acidic reagent.

The SAP number, % polyolefin conversion, insoluble resin content, soluble resin content, and succinic ratio of the polyalkenyl derivative are all dependent on the concentration of the strong acid, the mole ratio of unsaturated acidic reagent to polyalkene (CMR), the unsaturated acidic reagent feed time (MA feed), the temperature of the reaction, and the reaction time (Hold time) of forming the polyalkenyl derivative. These reaction parameters can be varied to obtain the desired properties for the polyalkenyl derivative.

Preferably, the mole ratio of unsaturated acidic reagent to polyalkene is preferably at least 1:1. More preferably, that mole ratio is from 1:1 to 4:1.

Preferably, the feed time of the unsaturated acidic reagent is from 0.4 to 1.2 hours. Preferably, the reaction time of forming the polyalkenyl derivative is from 2 to 6 hours.

To achieve high conversion, the reaction is best conducted by contacting the polyalkene, the unsaturated acidic reagent and the strong acid at reaction temperatures. The presence of the strong acid results in an increase in the % conversion of the polyalkene. The presence of the strong acid also results in low insoluble resin, low soluble resin, and low succinic ratio. But this is also dependent on the other reaction conditions such as MA feed time, the mole ratio of unsaturated acidic reagent to polyalkene (CMR), the reaction time, and the reaction temperature.

We have found that the strong acid results in isomerization of the end group double bond of the polyalkene. This is especially true in the absence of the unsaturated acidic reagent. For example, if the end group composition of the polyalkene consists mostly of the methylvinylidene isomer, the strong acid treatment of the polyalkene results in isomerization of the methylvinylidene isomer to a trisubstituted isomer, a tetrasubstituted isomer, and other isomers whose structures have not yet been determined. This isomerization is dependent on the reaction time, the temperature, and the concentration of the strong acid. If the strong acid is added to a mixture of the polyalkene and the unsaturated acidic reagent, then an isomerization of the polyalkene and an increase in the % conversion of the polyalkene is obtained. In addition, other side reactions, such as dimerization of the polyalkene, isomerization of the double bond of the polyalkylene derivative, etc. may take place. These side reactions are also considered to be part of the scope of this invention.

In one embodiment of conducting this reaction we have generally found it convenient to first add the polyalkene and the strong acid, let the polyalkene and strong acid react to reduce the amount of methylvinylidene end groups in the polyalkene, then react it with the unsaturated acidic reagent. This is convenient because generally the polyalkene is usually heated to remove traces of water before addition of the unsaturated acidic reagent. The strong acid can be added at this time resulting in no increase in the batch cycle time.

Preferably, in this embodiment, the pretreatment of polyalkene with a strong acid prior to the addition of the unsaturated acidic reagent is sufficient to produce a polyalkylene having less than 50% (more preferably less than 40%) methylvinylidene end groups.

Previous workers have shown that polyalkenes, such as polyisobutene, that contains high amounts of the methylvinylidene isomer give improved conversion due to the more reactive methylvinylidene isomer. In fact, high conversion can be obtained from polyisobutene that contains high amounts of the methylvinylidene isomer by increasing the maleic anhydride/polybutene CMR, the reaction time, the reaction pressure, or the reaction temperature. The process of this invention is an improvement over this process because, in this invention, higher maleic anhydride/polybutene CMR, reaction times, pressures or temperatures are not required to obtain higher conversion.

In another embodiment of this invention, the strong acid, polyalkene and unsaturated acidic reagent are added together at the beginning of the reaction. Then the temperature is increased so that isomerization of the methylvinylidene end group of the polyalkene occurs but reaction with the unsaturated acidic reagent does not take place. Then after the methylvinylidene content reaches the desired level, the temperature is increased sufficiently so that the reaction of the polybutene with the unsaturated acidic reagent to form polyalkylene derivative takes place.

In other alternative embodiments, the polyalkene, the strong acid, and the unsaturated acidic reagent are all added together, or the polyalkene and the unsaturated acidic reagent can be added first, followed by the addition of the strong acid. Other possible orders of addition are possible (such as polyalkene and part of the strong acid, then the unsaturated acidic reagent, then the rest of the strong acid). All possible orders of addition are considered to be within the scope of this invention.

The temperature of the reaction can vary over a wide range. Preferably, the temperature is in the range of from 180° to 240° C. The pressure can be atmospheric, sub-atmospheric, or super-atmospheric. Preferably, the pressure is super-atmospheric.

THE POLLYALKENE

The polyalkene can be a polymer of a single type of olefin or it can be a copolymer of two or more types of olefins. Preferably, the polyalkene is a polybutene, more preferably a polyisobutene. Preferably, the polyalkene has a $M_n$ of from 500 to 3000.

The polyalkene could also be formed from a metallocene olefin or an alpha olefin (such as a polyethylene having a $M_n$ of from 500 to 3000). By metallocene olefins we mean those polyolefins or mixtures of polyolefins that are prepared using metallocene catalysts. Often a mixture of ethylene and alpha olefin are copolymerized using a metallocene/alumoxane catalyst to produce polyolefins that are useful as raw materials for ashless dispersants. These materials are described in EP 440 507 A2, and U.S. Pat. No. 5,652,202 and references cited therein.

The end group of the polyalkene can be of any type. Included types are monosubtituted, disubstituted—both methylvinylidene and cis and trans disubstituted, trisubstituted, and tetra substituted. We prefer to use polyolefins that contain the disubstituted or trisubstituted end group structures or mixtures thereof.

We especially prefer to use a polyalkene that initially contains greater than about 50% of the methylvinylidene isomer, and the polyalkene is treated with strong acid prior to the reaction with the unsaturated acidic reagent so that less than 50% of the polyalkene has methylvinylidene end groups

THE UNSATURATED ACIDIC REAGENT

The term "unsaturated acidic reagent" refers to maleic or fumaric reactants, as defined in the Definitions Section above.

THE STRONG ACID

The term "strong acid" refers to an acid having a $pK_a$ of less than about 4. Preferably, the strong acid is an oil-soluble, strong organic acid, but even nonorganic strong acids would work (e.g., HCl, $H_2SO_4$, $HNO_3$, HF, etc.). More preferably, the strong acid is a sulfonic acid. Still more preferably, the sulfonic acid is an alkyl aryl sulfonic acid. Most preferably, the alkyl group of said alkyl aryl sulfonic acid has from 4 to 30 carbon atoms.

Preferably, the sulfonic acid is present in an amount in the range of from 0.0025% to 1% based on the total weight of polyalkene.

THE UNSATURATED ACIDIC REAGENT COPOLYMER

The unsaturated acidic reagent copolymers used in the present invention can be random copolymers or alternating copolymers, and can be prepared by known procedures. Further, in most instances, examples of each class are readily commercially available. Such copolymers may be prepared by the free radical reaction of an unsaturated acidic reagent with the corresponding monomer of the other unit of the copolymer. For example, the unsaturated acidic reagent copolymer can be prepared by the free radical reaction of an unsaturated acidic reagent, preferably maleic anhydride, with the corresponding $C_8$ to $C_{48}$ α-olefin, $C_8$ to $C_{48}$ polyalkylene, ethylene, styrene, 1,3-butadiene, $C_{3+}$ vinyl alkyl ether, or $C_{4+}$ vinyl alkanoate.

Copolymers of maleic anhydride and low molecular polybutene are other examples of suitable copolymers. Low molecular weight polybutenes are 550 molecular weight and less.

We prefer to use alpha olefins from $C_{12}$ to $C_{28}$ because these materials are commercially readily available, and because they offer a desirable balance of the length of the molecular weight tail, and the solubility of the copolymer in nonpolar solvents. Mixtures of olefins, e.g. $C_{14}$, $C_{16}$, and $C_{18}$ are especially desirable.

The degree of polymerization of the copolymers can vary over a wide range. In general copolymers of high molecular weight can be produced at low temperatures and copolymers of low molecular weight can be produced at high temperatures. It has been generally shown that for the polymers of this invention, we prefer low molecular weight copolymers, i.e., low molecular weight (2000–4800 for example) because higher molecular weight copolymers (greater than 10,000 for example) can sometimes produce polymers that contain gels.

The copolymerization is conducted in the presence of a suitable free radical initiator; typically a peroxide type initiator, e.g. di(t-butyl) peroxide, dicumyl peroxide, or azo type initiator, e.g., isobutylnitrile type initiators. Procedures for preparing poly α-olefin copolymers are, for example, described in U.S. Pat. Nos. 3,560,455 and 4,240,916, hereby incorporated by reference in their entirety. Both patents also describe a variety of initiators.

There is a wide range of suitable solvents that can be used for the preparation of the copolymers. We have found that alkyl aromatic solvents such as toluene, ethylbenzene, cumene, $C_9$ aromatic solvents, etc., are desirable because the molecular weight of the copolymer that is obtained using these solvents is in the desired range. However, any solvent that produces the desired molecular weight range, including using no solvent at all, is acceptable.

Some examples of maleic anhydride α-olefin copolymers are:

Poly(styrene-co-maleic anhydride) resins: These materials are known as SMA® resins. There are two molecular weight versions. The low molecular weight resin is called SMA resin and is available from ARCO Chemical with styrene to maleic anhydride ratio's of 1:1, 2:1, and 3:1. The high molecular weight resin is produced by Monsanto (Lytron®), ARCO (Dylark®) or American Cyanamide (Cypress®). Other names for SMA copolymers are Styrolmol, Maron MS, and Provimal ST resins. In some cases, partially esterified resins are also available.

Poly(ethylene-co-maleic anhydride) resins: These materials are manufactured by Monsanto under the trade name EMA®. They are also called Malethamer and Vinac resins.

Poly(alpha olefin-co-maleic anhydride) resins are available from Chevron Chemical as PA-18 (octadecene-1-co-maleic anhydride), or can be prepared as in Preparation 1. Alternately mixtures of alpha olefins can be used. These materials have been described in U.S. Pat. Nos. 3,461,108; 3,560,455; 3,560,456; 3,560,457; 3,580,893; 3,706,704; 3,729,450; and 3,729,451. Partially esterified olefin co maleic anhydride resins can also be used. Some examples of these types of resins are called Ketjenlube® resins available from AKZO Co.

Poly(isobutene-co-maleic anhydride) resins are called ISOBAM® and are manufactured by Curaray Co. Ltd. They are also available from Humphrey chemical Co. under the code K-66.

Poly(butadiene-co-maleic anhydride) resins are called Maldene® and are made by Borg-Warner Corp.

Poly(methylvinylether-co-maleic anhydride) resins are sold by GAF Corporation under the name Gantrey An. Other names are called Visco Frey.

Poly(vinylacetate-co-maleic anhydride) resins are available from Monsanto and are called Lytron 897, 898, and 899. They are also called Pouimalya resins in Europe.

We have found that excellent results can be obtained using a copolymer prepared by the free radical polymerization of maleic anhydride and $C_{12}$ to $C_{18}$ α-olefins or olefin mixtures thereof.

THE POLYAMINE REACTANT

The polyamine reactant should preferably have at least three amine nitrogen atoms per mole, and more preferably 4 to 12 amine nitrogens per molecule. Most preferred are polyamines having from about 6 to about 10 nitrogen atoms per molecule. The number of amine nitrogen atoms per molecule of polyamine is calculated as follows:

$$\text{Average number of nitrogen atoms in molecule of polyamine} = \frac{\%N \times M_{pa}}{14 \times 100}$$

wherein % N=percent nitrogen in polyamine or polyamine mixture $M_{pa}$=number average molecular weight of the polyamine or polyamine mixture Preferred polyalkylene polyamines also contain from about 4 to about 20 carbon atoms, there being preferably from 2 to 3 carbon atoms per alkylene unit. The polyamine preferably has a carbon-to-nitrogen ratio of from 1:1 to 10:1.

Examples of suitable polyamines that can be used to form the compounds of this invention include the following: tetraethylene pentamine, pentaethylene hexamine, Dow E-100® heavy polyamine (available from Dow Chemical Company, Midland, Mich.), and Union Carbide HPA-X heavy polyamine (available from Union Carbide Corporation, Danbury, Conn.). Such amines encompass isomers, such as branched-chain polyamines, and the previously mentioned substituted polyamines, including hydrocarbyl-substituted polyamines. HPA-X heavy polyamine ("HPA-X") contains an average of approximately 6.5 amine nitrogen atoms per molecule. Such heavy polyamines generally afford excellent results.

The polyamine reactant may be a single compound but typically will be a mixture of compounds reflecting commercial polyamines. Typically, the commercial polyamine will be a mixture in which one or several compounds predominate with the average composition indicated. For example, tetraethylene pentamine prepared by the polymerization of aziridine or the reaction of dichloroethylene and ammonia will have both lower and higher amine members, e.g., triethylene tetramine ("TETA"), substituted piperazines and pentaethylene hexamine, but the composition will be largely tetraethylene pentamine, and the empirical formula of the total amine composition will closely approximate that of tetraethylene pentamine.

Other examples of suitable polyamines include admixtures of amines of various sizes, provided that the overall mixture contains at least 4 nitrogen atoms per molecule. Included within these suitable polyamines are mixtures of diethylene triamine ("DETA") and heavy polyamine. A preferred polyamine admixture reactant is a mixture containing 20% DETA and 80% HPA-X; as determined by the method described above, this preferred polyamine reactant contains an average of about 5.2 nitrogen atoms per mole.

Methods of preparation of polyamines and their reactions are detailed in Sidgewick's THE ORGANIC CHEMISTRY OF NITROGEN, Clarendon Press, Oxford, 1966; Noller's CHEMISTRY OF ORGANIC COMPOUNDS, Saunders, Philadelphia, 2nd Ed., 1957; and Kirk-Othmer's ENCYCLOPEDIA OF CHEMICAL TECHNOLOGY, 2nd Ed., especially Volumes 2, pp. 99–116.

POST-TREATMENTS

We have found that the dispersancy of the present succinimides is generally further improved by reaction with a cyclic carbonate. This may result in some reduction in fluorocarbon elastomer compatibility. However, this generally can be more than offset by reducing the concentration of the carbonated post-treated polymer in light of the increased dispersancy. The cyclic carbonate post-treatment is especially advantageous where the dispersant will be used in engines which do not have fluorocarbon elastomer seals. The resulting modified polymer has one or more nitrogens of the polyamino moiety substituted with a hydroxy hydrocarbyl oxycarbonyl, a hydroxy poly(oxyalkylene) oxycarbonyl, a hydroxyalkylene, hydroxyalkylenepoly-(oxyalkylene), or mixture thereof.

The cyclic carbonate post-treatment is conducted under conditions sufficient to cause reaction of the cyclic carbonate with the secondary amino group of the polyamino substituents. Typically, the reaction is conducted at temperatures of about from 0° C. to 250° C., preferably about from 100° C. to 200° C. Generally, best results are obtained at temperatures of about from 150° C. to 180° C.

The reaction may be conducted neat, wherein both the polymer and the cyclic carbonate are combined in the proper ratio, either alone or in the presence of a catalyst (such as an acidic, basic or Lewis acid catalyst). Depending on the viscosity of the polymer reactant, it may be desirable to conduct the reaction using an inert organic solvent or diluent, for example, toluene or xylene. Examples of suitable catalysts include, for example, phosphoric acid, boron trifluoride, alkyl or aryl sulfonic acid, and alkali or alkaline carbonate.

The reaction of polyamino alkenyl or alkyl succinimides with cyclic carbonates is known in the art and is described in U.S. Pat. No. 4,612,132, hereby incorporated by reference, in its entirety. Generally, the procedures described to post-treat polyamino alkenyl or alkyl succinimides with cyclic carbonates can also be applied to post-treat the the succinimides of the present invention.

A particularly preferred cyclic carbonate is 1,3-dioxolan-2-one (ethylene carbonate) because it affords excellent results and it is readily commercially available.

The molar charge of cyclic carbonate employed in the post-treatment reaction is preferably based upon the theoretical number of basic nitrogens contained in the polyamino substituent of the succinimide. Thus, when one equivalent of tetraethylene pentamine ("TEPA") is reacted with one equivalent of succinic anhydride and one equivalent of copolymer, the resulting bis succinimide will theoretically contain 3 basic nitrogens. Accordingly, a molar charge of 2 would require that two moles of cyclic carbonate be added for each basic nitrogen or, in this case, 6 moles of cyclic carbonate for each mole equivalent of polyalkylene succinimide or succinimide prepared from TEPA. Mole ratios of the cyclic carbonate to the basic amine nitrogen of the polyamino alkenyl succinimide employed in the process of this invention are typically in the range of from about 1:1 to about 4:1; although preferably from about 2:1 to about 3:1.

As described in U.S. Pat. No. 4,612,132, cyclic carbonates may react with the primary and secondary amines of a polyamino alkenyl or alkyl succinimide to form two types of compounds. In the first instance, strong bases, including unhindered amines such as primary amines and some secondary amines, react with an equivalent of cyclic carbonate to produce a carbamic ester. In the second instance, hindered bases, such as hindered secondary amines, may react with an equivalent of the same cyclic carbonate to form a hydroxyalkyleneamine linkage. (Unlike the carbamate products, the hydroxyalkyleneamine products retain their basicity.) Accordingly, the reaction of a cyclic carbonate may yield a mixture of products. When the molar charge of the cyclic carbonate to the basic nitrogen of the succinimide is about 1 or less, a large portion of the primary and secondary amines of the succinimide will be converted to hydroxy hydrocarbyl carbamic esters with some hydroxyhydrocarbylamine derivatives also being formed. As the mole ratio is raised above 1 increased amounts of poly(oxyalkylene) polymers of the carbamic esters and the hydroxyhydrocarbylamine derivatives are produced, this is also known as stringing of the hydroxy ethyl groups.

We have found unexpectedly that the ethylene carbonate (EC) post-treated products of this invention have desirable properties. The ethylene carbonate treatment of the succinimides of this invention made with sulfonic acid treatment produce larger amounts of stringing of the hydroxy ethyl groups than in the ethylene carbonate treatment of the succinimides made without sulfonic acid. This can be observed by obtaining a quantitative $^{13}C$ NMR spectrum of the EC treated succinimides and measuring the ratio of the areas of the peaks at 70 and 72 ppm. This 70/72 ratio is an indication of the amount of stringing of the hydroxy ethyl groups. A greater amount of stringing is believed to give improved properties in the succinimide. The quantitative $^{13}C$ NMR spectrum is obtained by dissolving the sample in deuterochloroform that contains about 0.05M chromium acetylacetonate. This is described in the paper by G. C. Levy and U. Edlund in the Journal of the American Chemical Society, volume 97, page 4482, 1975.

The area of the 70/72 peaks for the ethylene carbonate treated products of this invention are included in the table, along with the area of the 70/72 peaks for typical products made without strong acid.

Comparison of the Amount of Stringing for the Sulfonic Acid Treated Products with the Untreated Products

| Sample | 70/72 ratio |
|---|---|
| Untreated | 1.57 |
| Treated with strong acid | 2.11 |

Both the polymers and post-treated polymers of this invention can also be reacted with boric acid or a similar boron compound to form borated dispersants having utility within the scope of this invention. In addition to boric acid (boron acid), examples of suitable boron compounds include boron oxides, boron halides, and esters of boric acid. Generally from about 0.1 equivalents to 10 equivalents of boron compound to the modified succinimide may be employed.

In addition to the carbonate and boric acids post-treatments both the compounds may be post-treated, or further post-treatment, with a variety of post-treatments designed to improve or impart different properties. Such post-treatments include those summarized in columns 27–29 of U.S. Pat. No. 5,241,003, hereby incorporated by reference. Such treatments include, treatment with:

- Inorganic phosphorous acids or anhydrates (e.g., U.S. Pat. Nos. 3,403,102 and 4,648,980);
- Organic phosphorous compounds (e.g., U.S. Pat. No. 3,502,677);
- Phosphorous pentasulfides;
- Boron compounds as already noted above (e.g., U.S. Pat. Nos. 3,178,663 and 4,652,387);
- Carboxylic acid, polycarboxylic acids, anhydrides and/or acid halides (e.g., U.S. Pat. Nos. 3,708,522 and 4,948,386);
- Epoxides polyepoxiates or thioexpoxides (e.g., U.S. Pat. Nos. 3,859,318 and 5,026,495);
- Aldehyde or ketone (e.g., U.S. Pat. No. 3,458,530);
- Carbon disulfide (e.g., U.S. Pat. No. 3,256,185);
- Glycidol (e.g., U.S. Pat. No. 4,617,137);
- Urea, thourea or guanidine (e.g., U.S. Pat. Nos. 3,312,619; 3,865,813; and British Patent GB 1,065,595);
- Organic sulfonic acid (e.g., U.S. Pat. No. 3,189,544 and British Patent GB 2,140,811);
- Alkenyl cyanide (e.g., U.S. Pat. Nos. 3,278,550 and 3,366,569);
- Diketene (e.g., U.S. Pat. No. 3,546,243);
- A diisocyanate (e.g., U.S. Pat. No. 3,573,205);
- Alkane sultone (e.g., U.S. Pat. No. 3,749,695);
- 1,3-Dicarbonyl Compound (e.g., U.S. Pat. No. 4,579,675);
- Sulfate of alkoxylated alcohol or phenol (e.g., U.S. Pat. No. 3,954,639);
- Cyclic lactone (e.g., U.S. Pat. Nos. 4,617,138; 4,645,515; 4,668,246; 4,963,275; and 4,971,711);

Cyclic carbonate or thiocarbonate linear monocarbonate or polycarbonate, or chloroformate (e.g., U.S. Pat. Nos. 4,612,132; 4,647,390; 4,648,886; 4,670,170);

Nitrogen-containing carboxylic acid (e.g., U.S. Pat. 4,971,598 and British Patent GB 2,140,811);

Hydroxy-protected chlorodicarbonyloxy compound (e.g., U.S. Pat. No. 4,614,522);

Lactam, thiolactam, thiolactone or ditholactone (e.g., U.S. Pat. Nos. 4,614,603 and 4,666,460);

Cyclic carbonate or thiocarbonate, linear monocarbonate or plycarbonate, or chloroformate (e.g., U.S. Pat. Nos. 4,612,132; 4,647,390; 4,646,860; and 4,670,170);

Nitrogen-containing carboxylic acid (e.g., U.S. Pat. No. 4,971,598 and British Patent GB 2,440,811);

Hydroxy-protected chlorodicarbonyloxy compound (e.g., U.S. Pat. No. 4,614,522);

Lactam, thiolactam, thiolactone or dithiolactone (e.g., U.S. Pat. Nos. 4,614,603, and 4,666,460);

Cyclic carbamate, cyclic thiocarbamate or cyclic dithiocarbamate (e.g., U.S. Pat. Nos. 4,663,062 and 4,666,459);

Hydroxyaliphatic carboxylic acid (e.g., U.S. Pat. Nos. 4,482,464; 4,521,318; 4,713,189);

Oxidizing agent (e.g., U.S. Pat. No. 4,379,064);

Combination of phosphorus pentasulfide and a polyalkylene polyamine (e.g., U.S. Pat. No. 3,185,647);

Combination of carboxylic acid or an aldehyde or ketone and sulfur or sulfur chloride (e.g., U.S. Pat. Nos. 3,390,086; 3,470,098);

Combination of a hydrazine and carbon disulfide (e.g. U.S. Pat. No. 3,519,564);

Combination of an aldehyde and a phenol (e.g., U.S. Pat. Nos. 3,649,229; 5,030,249; 5,039,307);

Combination of an aldehyde and an O-diester of dithiophosphoric acid (e.g., U.S. Pat. No. 3,865,740);

Combination of a hydroxyaliphatic carboxylic acid and a boric acid (e.g., U.S. Pat. No. 4,554,086);

Combination of a hydroxyaliphatic carboxylic acid, then formaldehyde and a phenol (e.g., U.S. Pat. No. 4,636,322);

Combination of a hydroxyaliphatic carboxylic acid and then an aliphatic dicarboxylic acid (e.g., U.S. Pat. No. 4,663,064);

Combination of formaldehyde and a phenol and then glycolic acid (e.g., U.S. Pat. No. 4,699,724);

Combination of a hydroxyaliphatic carboxylic acid or oxalic acid and then a diisocyanate (e.g. U.S. Pat. No. 4,713,191);

Combination of inorganic acid or anhydride of phosphorus or a partial or total sulfur analog thereof and a boron compound (e.g., U.S. Pat. No. 4,857,214);

Combination of an organic diacid then an unsaturated fatty acid and then a nitrosoaromatic amine optionally followed by a boron compound and then a glycolating agent (e.g., U.S. Pat. No. 4,973,412);

Combination of an aldehyde and a triazole (e.g., U.S. Pat. No. 4,963,278);

Combination of an aldehyde and a triazole then a boron compound (e.g., U.S. Pat. No. 4,981,492);

Combination of cyclic lactone and a boron compound (e.g., U.S. Pat. No. 4,963,275 and 4,971,711).

LUBRICATING OIL COMPOSITIONS AND CONCENTRATES

The compositions of this invention are compatible with fluorocarbon elastomer seals, at concentrations at which they are effective as detergent and dispersant additives in lubricating oils. When employed in this manner, the modified polyamino alkenyl or alkyl succinimide additive is usually present in from 1 to 5 percent by weight (on a dry polymer basis) to the total composition and preferably less than 3 percent by weight (on a dry or actives polymer basis). Dry or actives basis indicates that only the active ingredient of this invention are considered when determining the amount of the additive relative to the remainder of a composition (e.g., lube oil composition, lube oil concentrate, fuel composition or fuel concentrate). Diluents and any other inactives are excluded. Unless otherwise indicated, in describing the lubricating oil and final compositions or concentrates, dry or active ingredient contents are intended with respect to the polyalkylene succinimides. This includes the novel polyalkylene succinimides of the present invention and also other reaction product or byproducts in the reaction product mixture which function as dispersants.

The lubricating oil used with the additive compositions of this invention may be mineral oil or synthetic oils of lubricating viscosity and preferably suitable for use in the crankcase of an internal combustion engine. Crankcase lubricating oils typically have a viscosity of about 1300 cSt at 0° F. (−17.8° C.) to 22.7 cSt at 210° F. (99° C.). The lubricating oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity such as didodecyl benzene can be used. Useful synthetic esters include the esters of both monocarboxylic acid and polycarboxylic acids as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acid and mono and dihydroxy alkanols can also be used.

Blends of hydrocarbon oils with synthetic oils are also useful. For example, blends of 10 to 25 weight percent hydrogenated 1-decene trimer with 75 to 90 weight percent 150 SUS (100° F.) mineral oil gives an excellent lubricating oil base.

Other additives which may be present in the formulation include detergents (overbased and non-overbased), rust inhibitors, foam inhibitors, corrosion inhibitors, metal deactivators, pour point depressants, antioxidants, wear inhibitors, zinc dithiophosphates and a variety of other well-known additives.

It is also contemplated that the modified succinimides of this invention may be employed as dispersants and detergents in hydraulic fluids, marine crankcase lubricants and the like. When so employed, the modified succinimide is added at from 0.1 to 5 percent by weight (on a dry polymer basis) to the oil, and preferably at from 0.5 to 5 weight percent (on a dry polymer basis).

Additive concentrates are also included within the scope of this invention. The concentrates of this invention usually include from 90 to 10 weight percent of an organic liquid diluent and from 10 to 90 weight percent (on a dry polymer basis) of the additive of this invention. Typically, the concentrates contain sufficient diluent to make them easy to handle during shipping and storage. Suitable diluents for the concentrates include any inert diluent, preferably an oil of lubricating viscosity, so that the concentrate may be readily mixed with lubricating oils to prepare lubricating oil compositions. Suitable lubricating oils which can be used as diluents typically have viscosities in the range from about 35 to about 500 Saybolt Universal Seconds (SUS) at 100° F. (38° C.), although an oil of lubricating viscosity may be used.

FUEL COMPOSITIONS AND CONCENTRATES

Typically the fuel composition will have about from 10 to 10,000 weight parts polyalkylene succinimide per million parts of base fuel. Preferably the fuel composition will have about from 30 to 2,000 weight parts polyalkylene succinimide per million parts of base fuel. This is based on active ingredient excluding inactives, for example diluent oil and any unreacted alkene or poly α-olefins etc. carried through from the preparation of the succinimide. If other detergents are present, a lesser amount of the modified succinimide may be used. Optimum concentrations can vary with the particular base oil and the presence of other additives, but can be determined by routine procedures.

The compositions of this invention may also be formulated as a fuel concentrate, using an inert stable oleophilic organic solvent boiling in the range of about 150° F. to 400° F. Preferably, an aliphatic or an aromatic hydrocarbon solvent is used, such as benzene, toluene, xylene or higher-boiling aromatics or aromatic thinners. Aliphatic alcohols of about 3 to 8 carbon atoms, such as isopropanol, isobutylcarbinol, n-butanol and the like, in combination with hydrocarbon solvents are also suitable for use with the fuel additive. The present fuel concentrate will typically contain about from 20% to 60% of the present composition on an active ingredient basis.

EXAMPLES

The invention will be further illustrated by the following examples, which set forth particularly advantageous method embodiments. While the Examples are provided to illustrate the present invention, they are not intended to limit it.

EFFECT ON METHYLVINYLIDENE CONCENTRATION

The following table shows the equilibrium methylvinylidene concentration that we determined by reacting the polybutene with $C_4$–$C_{30}$ sulfonic acid at different temperatures. This was determined by using quantitative $^{13}C$ NMR spectroscopy. The initial % methylvinylidene (% MV content) was 84%.

TABLE 1

| Equilibrium % methylvinylidene concentration of polybutene samples | | |
|---|---|---|
| Sulfonic Acid, ppm | Temperature, ° K. | % MV content |
| 264 | 373 | 50 |
| 264 | 413 | 40 |
| 264 | 433 | 39 |
| 264 | 473 | 30 |
| 264 | 493 | 27 |
| 1039 | 373 | 36 |
| 1039 | 423 | 37 |
| 1039 | 433 | 32 |
| 1039 | 473 | 28 |
| 1039 | 493 | 30 |
| 4973 | 373 | 32 |
| 4973 | 393 | 21 |
| 4973 | 413 | 24 |
| 4973 | 453 | 22 |

TABLE 1-continued

| Equilibrium % methylvinylidene concentration of polybutene samples | | |
|---|---|---|
| Sulfonic Acid, ppm | Temperature, ° K. | % MV content |
| 4973 | 473 | 23 |
| 4973 | 493 | 22 |

SYNTHESIS OF POLYALKENYL DERIVATIVES OF UNSATURATED ACIDIC REAGENT

The following examples describe the synthesis of various examples of polyalkenyl derivatives of an unsaturated acidic reagent.

Comparative Example A

Preparation of Thermal PIBSA without Sulfonic Acid

To a 12L stainless steel reactor was charged 4000 g Glissopal 2200 polybutene (1.74 mol, 81% methylvinylidene content). This was heated to 232° C. for 15 minutes to dehydrate the sample, and the pressure was increased to 24.7 Psia. To this was added 356 g maleic anhydride, MA, (3.63 mol) over 0.6 hr at a constant rate. The maleic anhydride/polybutene CMR was 2.0. This was heated at 232° C. for 6 hours. Then excess maleic anhydride was removed in vacuo. The product was filtered and cooled. This product had a SAP number of 58.6 mg KOH/g sample, and contained 82% actives. The sediment level was 0.17%.

Comparative Examples B–F

The comparative Example A was repeated with different MA feeds, CMR's, hold times, etc. These are reported in Table 2.

Example 1

Preparation of Sulfonic Acid Catalyzed PIBSA

The procedure for Comparative Example A was followed exactly except that 250 ppm $C_4$–$C_{30}$ alkyl sulfonic acid (1.0 g) was added to the reactor with the polybutene. Then the maleic anhydride was added and the reaction was completed. This product had a SAP number of 55.0 mg KOH/g sample, and contained 90% actives. The sediment level was 0.45%.

Example 2

Preparation of Sulfonic Acid Catalyzed PIBSA from Rearranged Polybutene

The procedure for Example 1 was followed exactly except that a total of 1000 ppm $C_4$–$C_{30}$ alkyl sulfonic acid (4.0 g) was added to the reactor with the polybutene. Then the mixture of polybutene and alkyl sulfonic acid was heated at 232° C. for 1.5 hours. At this time the % methylvinylidene content of the polybutene had fallen to less than 40% of the initial value as determined by examination of the 890 $cm^{-1}$ peak of the FTIR spectrum. Then the maleic anhydride was added, and the reaction was completed. This product had a SAP number of 54.6 mg KOH/g sample, and contained 91% actives. The sediment level was 0.26%.

Examples 3

Preparation of Sulfonic Acid Catalyzed PIBSA by Adding the Sulfonic Acid After at least 25% Conversion The procedure of Example 1 was followed except that 250 ppm of $C_4$–$C_{30}$ sulfonic acid (1.0 g) was added after 67.7% conversion of the polybutene to the desired product. This was determined by measuring the % actives of a sample and then converting it to % conversion. In addition the maleic anhydride/polybutene CMR was 3.0. The total reaction time was 2 hours. This product had a SAP number of 59.3 mg KOH/g sample, and contained 92% actives. The sediment level was 0.4%.

Examples 4–16

The reaction of 2300 MW polybutene with maleic anhydride and strong acid under a number of different reaction conditions.

A number of other examples of sulfonic acid catalyzed PIBSA were prepared using different reaction conditions. These are summarized in Table 2.

Example 17–29

The reaction of 1000 MW polybutene with maleic anhydride and strong acid under a number of different reaction conditions.

A number of other examples of sulfonic acid catalyzed PIBSA were prepared from 1000 molecular weight polybutene using different reaction conditions. These are summarized in Table 3.

Comparative Examples G–K

A number of examples of PIBSA prepared with 1000 molecular weight polybutene without sulfonic acid catalysis are reported in Table 3.

TABLE 2

Experimental data for the reaction of 2300 Mw polybutene with maleic anhydride and a strong acid at 232° C. at 24.7 Psia

| Ex. | $C_4$—$C_{30}$ sulfonic acid, ppm | conversion before strong acid | MA feed | MA CMR | Hold time | SAP No. | % actives | PIB $M_n$ | Succinic Ratio | % sediment |
|---|---|---|---|---|---|---|---|---|---|---|
| A | 0 | — | 0.6 | 2.0 | 6 | 58.6 | 82.3 | 2094 | 1.42 | 0.17 |
| 1 | 250 | 0% | 0.6 | 2.0 | 6 | 55.0 | 89.6 | 2094 | 1.21 | 0.45 |
| 2 | 250* | 0% | 0.6 | 2.0 | 6 | 54.6 | 90.5 | 2094 | 1.19 | 0.26 |
| 3 | 250 | 66.6% | 1.2 | 3.0 | 2 | 59.3 | 92.3 | 2094 | 1.27 | 0.4 |
| B | 0 | — | 0.4 | 1.5 | 6 | 51.8 | 78.9 | 2094 | 1.30 | 0.1 |
| 4 | 1000 | 0% | 0.4 | 1.5 | 6 | 46.8 | 83.1 | 2094 | 1.11 | 0.09 |
| C | 0 | — | 0.5 | 1.75 | 6 | 55.0 | 80.1 | 2094 | 1.36 | 0.14 |
| 5 | 1000 | 0% | 0.5 | 1.75 | 6 | 48.5 | 86.0 | 2094 | 1.11 | 0.13 |
| 6 | 1000 | 0% | 0.6 | 2.0 | 6 | 53.3 | 89.8 | 2094 | 1.17 | 0.34 |
| D | 0 | — | 0.5 | 1.5 | 6 | 51.6 | 80.1 | 2269 | 1.38 | 0.09 |
| 7 | 80 | 0% | 0.5 | 1.5 | 6 | 52.0 | 82.6 | 2269 | 1.35 | 0.06 |
| 8 | 250 | 57.6% | 1.0 | 2.5 | 2 | 54.9 | 90.1 | 2094 | 1.20 | 0.20 |
| 9 | 250 | >25% | 1.0 | 2.5 | 2 | 54.2 | 88.4 | 2240 | 1.29 | 0.6 |
| 10 | 250 | 0 | 1.2 | 3.0 | 2 | 57.2 | 91.4 | 2094 | 1.24 | — |
| 11 | 250 | >25% | 1.2 | 3.0 | 2 | 59.6 | 90.8 | 2240 | 1.39 | 0.5 |
| 12 | 250 | >25% | 1.2 | 3.0 | 2 | 58.6 | 89.5 | 2240 | 1.39 | 1.0 |
| 13 | 1000 | >25% | 1.2 | 3.0 | 3 | 56.2 | 90.0 | 2240 | 1.32 | — |
| 14 | 250 | 70.8% | 1.0 | 3.5 | 3 | 61.6 | 94.0 | 2094 | 1.30 | 1.3 |
| E | 0 | — | 1.0 | 3.5 | 6 | 59.8 | 80 | 2431 | 1.73 | 1.1 |
| 15 | 1000 | 0% | 1.0 | 3.5 | 6 | 52.8 | 90.9 | 2431 | 1.33 | 0.7 |
| 16 | 500 | >25% | 1.2 | 3.0 | 2 | 57.7 | 92.2 | 2240 | 1.32 | 0.4 |
| F | 0 | — | 0.62 | 1.60 | 1.5 | 50 | 78 | — | — | 0.02 |

*In Example 2, the sulfonic acid was added before the maleic anhydride was added. The methylvinylidene content decreased to less than 40% before the maleic anhydride addition.

TABLE 3

Experimental data for the reaction of 1000 Mw polybutene with maleic anhydride and a strong acid at 232° C. at 24.7 Psia

| Ex. | $C_4$—$C_{30}$ sulfonic acid, ppm | conversion before strong acid | MA feed | MA CMR | Hold time | SAP Np. | % actives | PIB $M_n$ | Succinic Ratio | % sediment |
|---|---|---|---|---|---|---|---|---|---|---|
| G | 0 | 0% | 1.0 | 1.35 | 6 | 112.6 | 85.2 | 1115 | 1.48 | 0.01 |
| 17 | 1000 | 0% | 1.0 | 1.35 | 6 | 107.6 | 89.3 | 1115 | 1.34 | 0.04 |
| H | 0 | 0% | 1.0 | 1.7 | 6 | 132.0 | 88.1 | 1115 | 1.71 | 0.09 |
| I | 0 | 0% | 1.0 | 1.7 | 6 | 134.3 | 89.0 | 1115 | 1.73 | 0.04 |
| 18 | 50 | 0% | 1.0 | 1.7 | 6 | 128.7 | 92.7 | 1115 | 1.57 | 0.09 |

TABLE 3-continued

Experimental data for the reaction of 1000 Mw polybutene with maleic anhydride and a strong acid at 232° C. at 24.7 Psia

| Ex. | $C_4$—$C_{30}$ sulfonic acid, ppm | conversion before strong acid | MA feed | MA CMR | Hold time | SAP Np. | % actives | PIB $M_n$ | Succinic Ratio | % sediment |
|---|---|---|---|---|---|---|---|---|---|---|
| 19 | 150 | 0% | 1.0 | 1.7 | 6 | 128.3 | 93.0 | 1115 | 1.56 | 0.13 |
| 20 | 250 | 0% | 1.0 | 1.7 | 6 | 123.8 | 93.4 | 1115 | 1.49 | 0.13 |
| 21 | 250 | 0% | 1.0 | 1.7 | 6 | 123.4 | 93.7 | 1115 | 1.48 | 0.05 |
| 22 | 250 | 0% | 1.0 | 1.7 | 6 | 124.4 | 93.8 | 1115 | 1.49 | 0.04 |
| 23 | 250 | 67.6% | 1.0 | 1.7 | 6 | 126.1 | 93.4 | 1115 | 1.52 | 0.02 |
| 24 | 250 | 80.9% | 1.0 | 1.7 | 6 | 130.1 | 94.0 | 1115 | 1.56 | 0.04 |
| 25 | 250 | 82.8% | 1.0 | 1.7 | 6 | 133.6 | 94.0 | 1115 | 1.61 | <0.01 |
| 26 | 500 | 0% | 1.0 | 1.7 | 6 | 119.4 | 93.1 | 1115 | 1.43 | 0.15 |
| 27 | 1000 | 0% | 1.0 | 1.7 | 6 | 123.0 | 93.6 | 1115 | 1.47 | 0.13 |
| 28 | 10000 | 0% | 1.0 | 1.7 | 6 | 79.9 | 68.5 | 1115 | 1.29 | 0.17 |
| J | 0 | 0% | 1.4 | 2.0 | 6 | 149.5 | 92.2 | 1115 | 1.88 | 0.02 |
| K | 0 | 0% | 1.4 | 2.0 | 6 | 149.1 | 91.5 | 1115 | 1.89 | 0.03 |
| 29 | 1000 | 0% | 1.4 | 2.0 | 6 | 132.5 | 94.2 | 1115 | 1.59 | 0.14 |

The examples in Table 2 and 3 show that the % actives of the PIBSA prepared with sulfonic acid catalysis were higher than the % actives of the PIBSA prepared in the absence of catalyst. In addition the succinic ratio of the PIBSA prepared with sulfonic acid catalysis was lower than the succinic ratio of the PIBSA prepared in the absence of catalyst.

The following example describes the synthesis of succinimides from the polyalkenyl derivative of an unsaturated acidic reagent, a copolymer, and an amine.

Example 30

Preparation of a Succinimide Using HPA as the Amine, 2300 MW PIBSA Made with Strong Acid Catalysis, and a $C_{10}$–$C_{24}$ Alpha Olefin Copolymer.

The PIBSA from Example 3, prepared using sulfonic acid catalysis, 151.11 g (0.08 mol) was dissolved in 92.62 g diluent oil and to this was added 48.1 g of a $C_{12}$–$C_{24}$ alpha olefin maleic anhydride copolymer (SAP number 128.9 mg KOH/g sample, 0.055 mol) dissolved in $C_9$ aromatic solvent. The copolymer/PIBSA CMR (based on anhydride equivalents) was 0.69 for this example. This was heated to 100° C. and to this was added 22.77 g heavy polyamine, HPA, (0.083 mol). The amine/anhydride CMR was 0.61. This was heated at 165° C. for 7 hours. About 29 g $C_9$ aromatic solvent and about 3.1 ml water was collected. The product contained 2.49% N, 56.4 TBN, and had a viscosity at 100° C. of 448 cSt. The data for this product and other products made under different conditions are reported in Table 4.

Example 31

Preparation of Ethylene Carbonate Treated Dispersants

To the product of Example 39, 240.41 g, was added 8.7 g of ethylene carbonate (0.1 mol). This was heated at 165° C. for 5 hours. The chemical and physical properties of this material are reported in Table 4.

Examples 32–36

Preparation of Other Succinimides

Other succinimides prepared under different conditions are also reported in Table 4.

TABLE 4

| Ex. | PIBSA Ex. | Copolymer/ PIBSA CMR | EC/ BN CMR | Amine/ anhydride CMR | % N | TBN | Viscosity cSt @ 100° C. |
|---|---|---|---|---|---|---|---|
| 30 | 3 | 0.69 | 0 | 0.61 | 2.49 | 56.4 | 448 |
| 31 | 3 | 0.69 | 1.6 | 0.61 | 2.31 | 34.5 | 5940 |
| 32 | 2 | 0.86 | 0 | 0.69 | 2.29 | 55.0 | 153 |
| 33 | 2 | 0.86 | 1.7 | 0.69 | 2.13 | 29.5 | 1420 |
| 34 | 2 | 0.43 | 0 | 0.45 | 1.34 | 27.4 | 166 |
| 35 | 2 | 0.43 | 2.0 | 0.45 | 1.26 | 16.9 | 392 |
| 36 | 13 | 0.32 | 1.93 | 0.49 | 1.29 | 16.8 | 896 |
| L | F | 0.43 | 2.0 | 0.45 | 1.26 | 15.2 | 551 |

The data in Table 4 shows that succinimides can be easily prepared using a variety of copolymer/PIBSA CMR, EC/BN CMR, and amine/anhydride CMR. We found that the succinimide of Example 35, which had a final viscosity of 392 cSt at 1.26% N, was less viscous than a corresponding succinimide that was prepared without the strong acid catalyst. This succinimide (Example L) had been prepared from a PIBSA that had been made using a MA feed of 0.62 hr, a MA CMR of 1.60 and a hold time of 1.5 hr. The PIBSA had a SAP number of 50 mg KOH/g sample, and contained 78% actives (Example F). The succinimide prepared in Example L had a viscosity of 551 cSt at 1.26% N. This was higher than the viscosity of Example 35, and indicates that lower viscosity products can be obtained using the products of this invention.

While the present invention has been described with reference to specific embodiments, this application is intended to cover those various changes and substitutions that may be made by those skilled in the art without departing from the spirit and scope of the appended claims.

What is claimed is:

1. A process for preparing a succinimide composition, said process comprising reacting a mixture under reactive conditions, wherein the mixture comprises:

(a) a polyalkenyl derivative of an unsaturated acidic reagent prepared by reacting an unsaturated acidic reagent with a polyalkene in the presence of a strong acid;

(b) an unsaturated acidic reagent copolymer of
(1) an unsaturated acidic reagent and
(2) an olefin; and (c) an alkylene polyamine.

2. A process according to claim 1 wherein the polyalkene initially contains greater than about 50% of the methylvinylidene isomer, and the polyalkene is treated with strong acid prior to the reaction with the unsaturated acidic reagent so that less than 50% of the polyalkene has methylvinylidene end groups.

3. A process according to claim 2 wherein the polyalkene is pretreated with a strong acid prior to the reaction with the unsaturated acidic reagent so that less than 40% of the polyalkene have methylvinylidene end groups.

4. A process according to claim 1 wherein said polyalkene is a polybutene.

5. A process according to claim 4 wherein said polybutene is a polyisobutene.

6. A process according to claim 1 wherein said polyalkene has a $M_n$ of from 500 to 3000.

7. A process according to claim 1 wherein said unsaturated acidic reagent of claim 1 (a) is maleic anhydride.

8. A process according to claim 1 wherein the mole ratio of unsaturated acidic reagent to polyalkene in the formation of the polyalkenyl derivative of an unsaturated acidic reagent is at least 1:1.

9. A process according to claim 1 wherein said strong acid is an oil-soluble, strong organic acid.

10. A process according to claim 9 wherein said strong acid is a sulfonic acid.

11. A process according to claim 10 wherein said sulfonic acid is an alkyl aryl sulfonic acid.

12. A process according to claim 11 wherein said alkyl group of said alkyl aryl sulfonic acid has from 4 to 30 carbon atoms.

13. A process according to claim 10 wherein the sulfonic acid is present in an amount in the range of from 0.0025% to 1% based on the total weight of polyalkene.

14. A process according to claim 1, wherein:

(a) in component (b) of claim 1, the olefin has an average of from 14 to 30 carbon atoms, the unsaturated acidic reagent is maleic anhydride, and the copolymer has a $M_n$ of from 2000 to 4800;

(b) in component (c) of claim 1, the polyamine having at least three nitrogen atoms and 4 to 20 carbon atoms; and (c) wherein said mixture contains from 1 to 10 equivalents of said polyalkenyl derivative per equivalent of said unsaturated acidic reagent copolymer and from 0.4 to 1 equivalents of said polyamine per equivalent of polyalkenyl derivative of an unsaturated acidic reagent plus unsaturated acidic reagent copolymer.

15. A process according to claim 1, wherein the polyamine has at least six nitrogen atoms.

16. A process according to claim 1, wherein, in the preparation of the polyalkenyl derivative of an unsaturated acidic reagent by reacting an unsaturated acidic reagent with a polyalkene in the presence of a strong acid, the unsaturated acidic reagent feed time is from 0.4 to 1.2 hours.

17. A process according to claim 1, wherein the reaction time of forming the polyalkenyl derivative is from 2 to 6 hours.

18. A succinimide composition produced by the process according to claim 1.

19. A concentrate comprising from 20% to 60% of the succinimide composition of claim 18 and from 80% to 40% of an organic diluent.

20. A lubricating oil composition comprising a major amount of an oil of lubricating viscosity and a minor amount of the succinimide composition of claim 18.

21. A fuel oil composition comprising a major amount of oil hydrocarbon boiling on the gasoline or diesel fuel range and from 10 to 10,000 parts per million of the succinimide composition of claim 18.

22. A post-treated succinimide composition prepared by treating the succinimide composition of claim 18 with a cyclic carbonate or a linear mono- or poly-carbonate under reactive conditions.

23. A post-treated succinimide composition according to claim 22 wherein said cyclic carbonate is ethylene carbonate.

24. A post-treated succinimide composition according to claim 23 wherein the ratio of 70/72 peaks in the quantitative $^{13}C$ NMR spectrum of said post-treated succinimide composition is at least 2.

25. A post-treated succinimide composition prepared by treating the succinimide composition of claim 18 under reactive conditions with a boron compound selected from the group consisting of boron oxide, boron halide, boric acid, and esters of boric acid.

* * * * *